US007677777B2

(12) United States Patent
Woodward et al.

(10) Patent No.: US 7,677,777 B2
(45) Date of Patent: Mar. 16, 2010

(54) LED APPARATUS FOR WORLD HOMOLOGATION

(75) Inventors: Ronald O. Woodward, Yorktown, VA (US); Christopher H. Wilson, Montreal (CA); Ronald G. Hare, Belleville (CA)

(73) Assignee: Magna International, Inc., Aurora (CA)

( * ) Notice: Subject to any disclaimer, the term of this patent is extended or adjusted under 35 U.S.C. 154(b) by 109 days.

(21) Appl. No.: 11/709,042

(22) Filed: Feb. 21, 2007

(65) Prior Publication Data

US 2008/0198574 A1 Aug. 21, 2008

(51) Int. Cl.
*F21V 9/00* (2006.01)

(52) U.S. Cl. ..... 362/511; 362/240; 362/244; 362/311.02; 362/521; 362/545; 362/555

(58) Field of Classification Search ..... 362/238, 362/240, 244, 311, 326, 331–332, 511, 520–522, 362/543–545, 554–556, 311.02
See application file for complete search history.

(56) References Cited

U.S. PATENT DOCUMENTS

| | | | | |
|---|---|---|---|---|
| 5,488,545 | A * | 1/1996 | Kato et al. | 362/551 |
| 7,070,311 | B2 * | 7/2006 | Lee | 362/545 |
| 2001/0052955 | A1 | 12/2001 | Nagatani | |
| 2003/0147252 | A1 * | 8/2003 | Fioravanti | 362/543 |
| 2006/0239024 | A1 | 10/2006 | Valcamp et al. | |

FOREIGN PATENT DOCUMENTS

| | | |
|---|---|---|
| CA | 2 251 730 | 10/1997 |
| JP | 2002 230514 | 8/2002 |
| JP | 2004 071409 | 3/2004 |

* cited by examiner

*Primary Examiner*—Jason Moon Han
(74) *Attorney, Agent, or Firm*—Warn Partners, P.C.; Marc Luddy

(57) ABSTRACT

A lamp assembly including a plurality of light sources, a plurality of light guides, and at least one lens. The plurality of light guides are optically connected to the plurality of light sources, and selected plurality of light sources emit light that is selectively propagated through the plurality of light guides. The at least one lens is optically connected to the plurality of light guides.

26 Claims, 11 Drawing Sheets

LED APPARATUS FOR WORLD HOMOLOGATION

FIELD OF THE INVENTION

The present invention relates to a lamp assembly.

BACKGROUND OF THE INVENTION

Most motorized vehicles have head lamps which are used to emit light in a region adjacent to the vehicle so that the vehicle can be operated during non-daylight hours. However, different countries or regions have different requirements for the light emitted from the lamp assembly. This is especially true when different countries and regions require the vehicle to be operated on different sides of the road. There are regulations or requirements as to the amount of light that can be emitted from the different portions of the lamp assembly depending upon many factors, such as which side of the road the vehicle is operated on, so that the emitted light does not obstruct other drivers. Thus, the lamp assembly on a vehicle from one region typically does not comply with the lamp assembly requirements of another region.

Head lamp assemblies can include mechanical components which can be altered in order to alter the pattern of light emitted from the lamp assembly. However, these mechanical components must be aligned when the vehicle is manufactured, which increases the parts needed for the lamp assembly and thus increases the manufacturing time and cost. Additionally, the mechanical components must be mechanically altered when the vehicle moves into a different region.

Therefore, it is desirable to develop a lamp assembly in which the light pattern emitted from the lamp assembly can be altered without requiring the movement of mechanical parts in order for the lamp assembly to comply with lamp assembly regulations and requirements of multiple regions.

SUMMARY OF THE INVENTION

The present invention relates to a lamp assembly including a plurality of light sources, a plurality of light guides, and at least one lens. The plurality of light guides are optically connected to the plurality of light sources, and selected plurality of light sources emit light that is selectively propagated through the plurality of light guides. The at least one lens is optically connected to the plurality of light guides.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
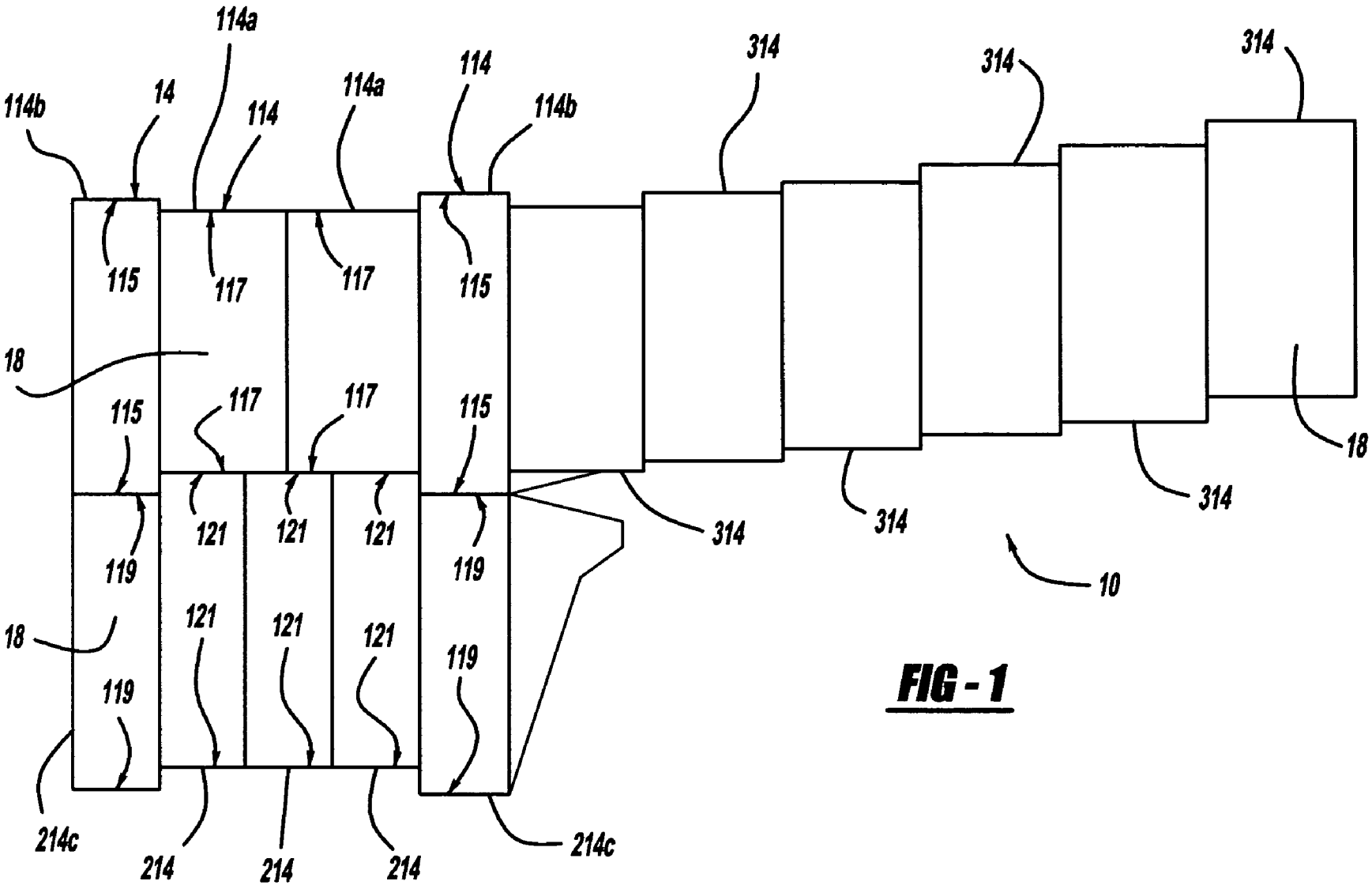
FIG. 1 is a schematic front view of a plurality of light guides in accordance with an embodiment of the present invention.
Figure 2:
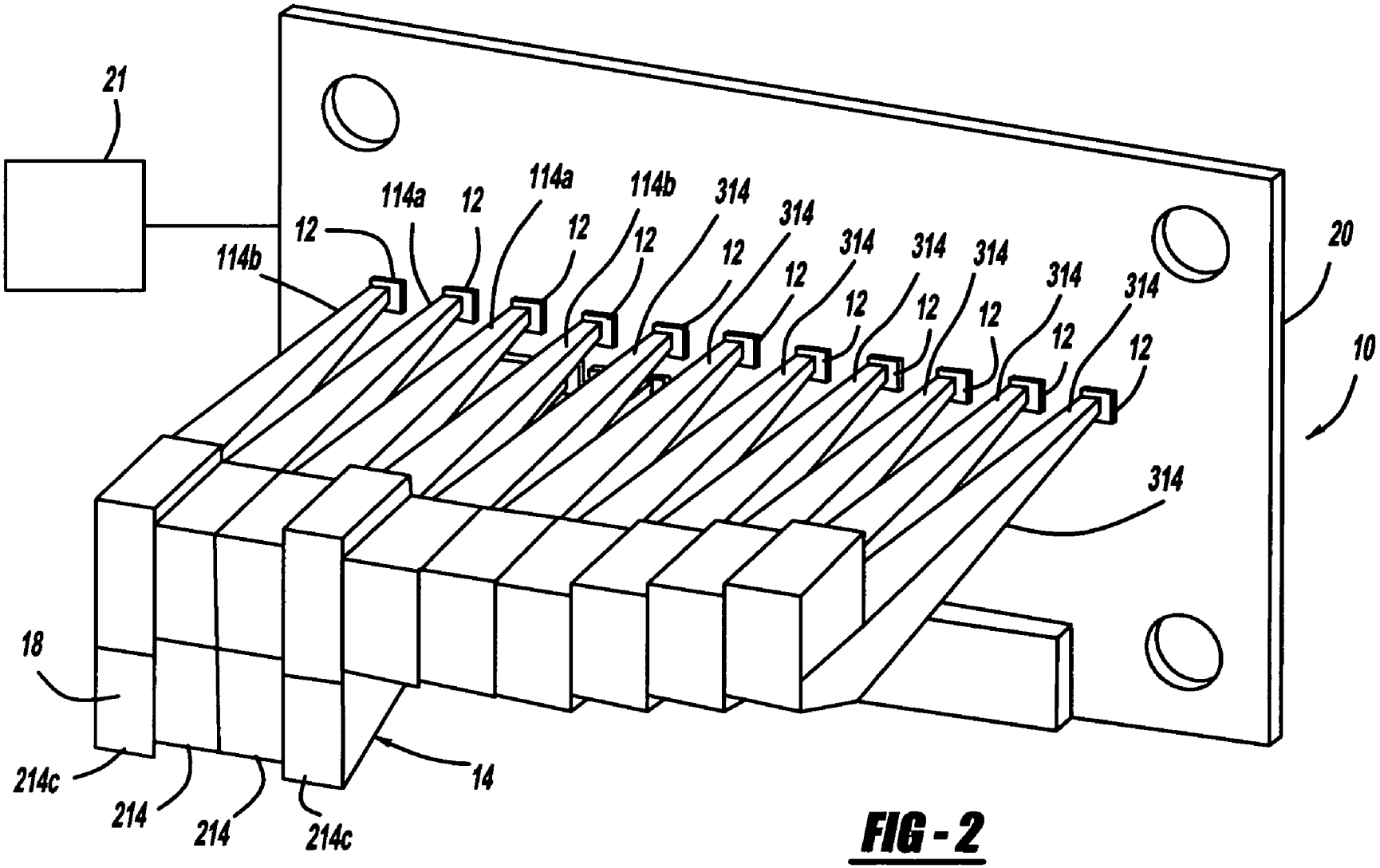
FIG. 2 is a schematic perspective view of a plurality of light guides optically connected to a plurality of light sources.
Figure 3:
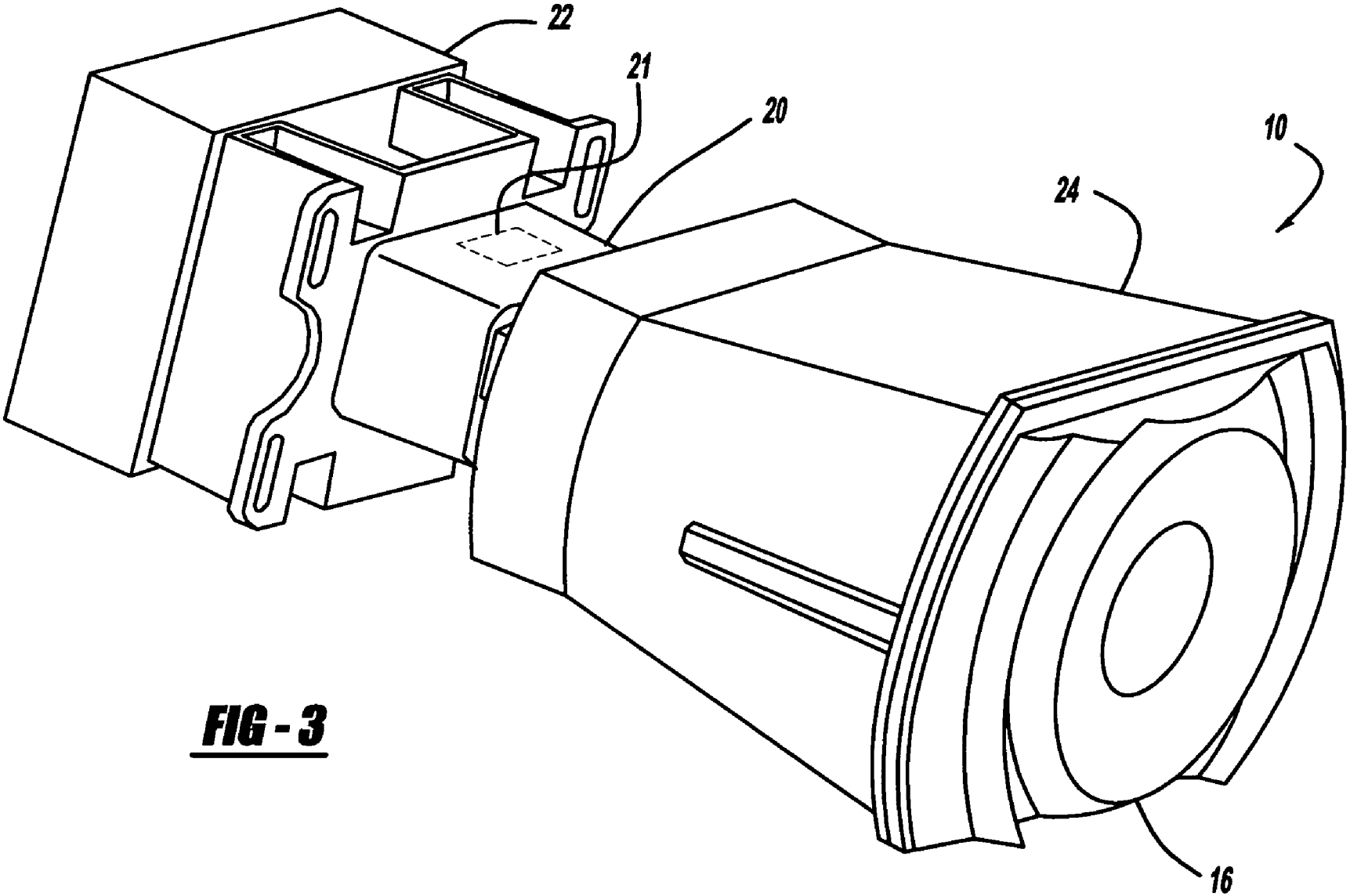
FIG. 3 is a perspective view of a lamp assembly in accordance with an embodiment of the present invention.

Referring to FIGS. 1-3, a lamp assembly is generally shown at 10. The lamp assembly 10 includes a plurality of light sources 12. A plurality of light guides generally indicated at 14, are optically connected to the light sources 12. The light sources 12 selectively emit light that is propagated through selected light guides 14. By way of explanation and not limitation, the light sources 12 can be light emitting diodes (LEDs), and at least one light source 12 can be optically connected to a single corresponding light guide 14. At least one lens 16 is optically connected to the plurality of light guides 14.

Figure 4:
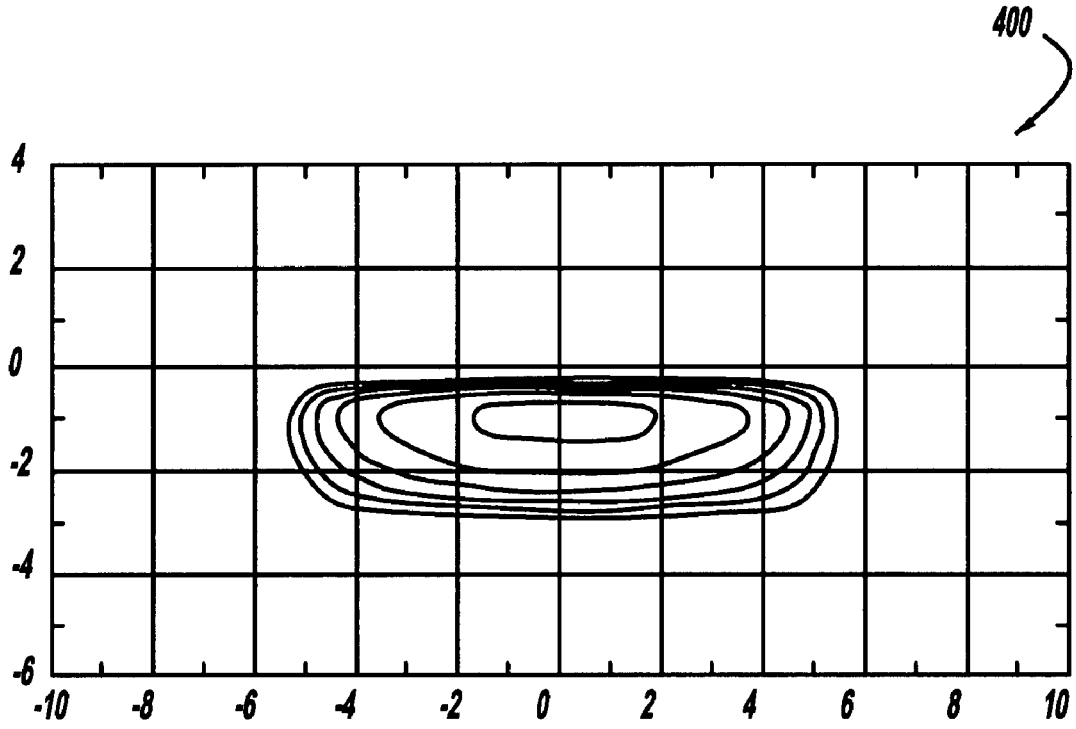
FIGS. 4-19 are graphs depicting various isomeric beam patterns in accordance with the invention.

The plurality of light guides 14 include a plurality of low beam light guides generally indicated at 114. Included in the plurality of low beam light guides 114 is at least one main low beam light guide 114*a*. When the lamp assembly 10 is activated, the light source 12 always emits light that propagates through the main low beam light guide 114*a*. There can be two main low beam light guides 114*a* which are adjacent to one another, so that the light sources 12 always emit light that is propagated through both low beam light guides 114*a* when the light assembly 10 is activated producing a beam pattern 400 as shown in FIG. 4. It should be appreciated that any number of low beam light guides 114*a* can be used depending upon the desired area to be illuminated by the lamp assembly 10 and the regulations for lighting the area, as described below.

Figure 5:
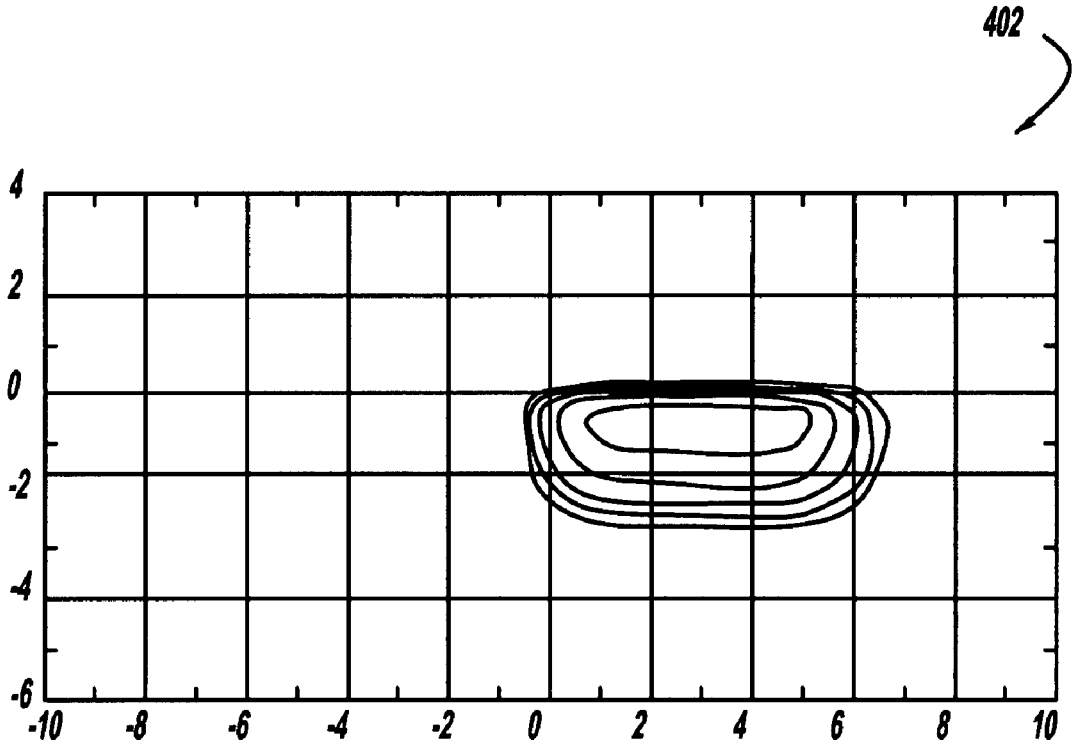
Figure 6:
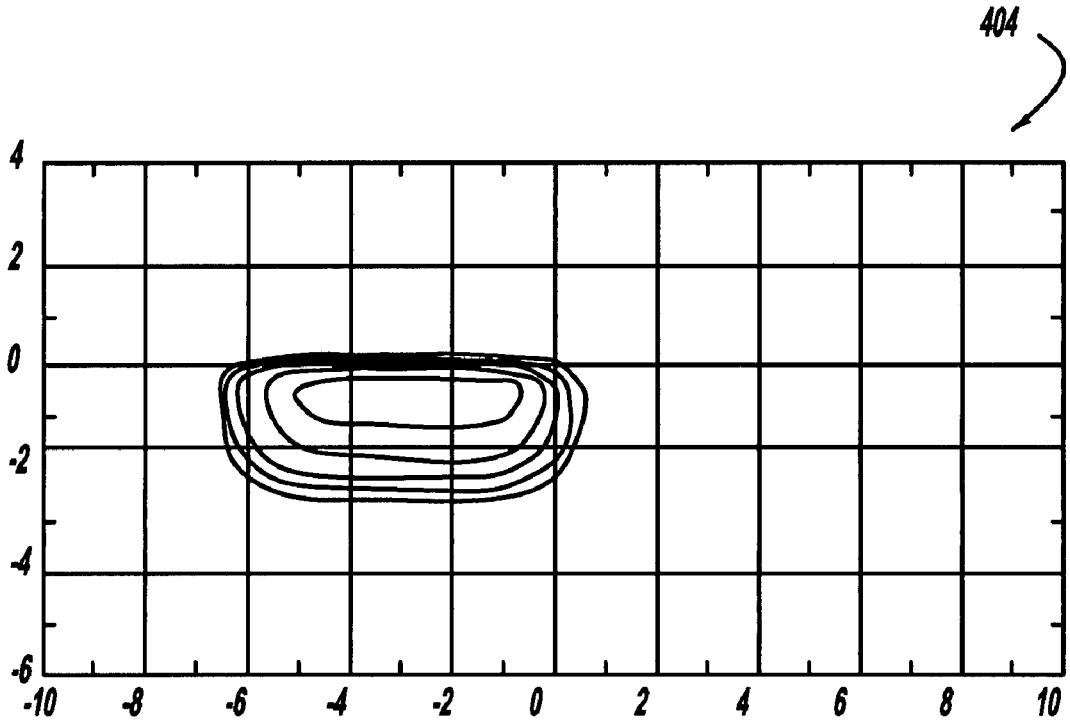

Additionally, the plurality of low beam light guides 114 include secondary low beam light guides 114*b* adjacent to both sides of the main low beam light guides 114*a*. At least one of the light sources 12 selectively emits light that propagates through one of the secondary low beam light guides 114*b* when the light assembly 10 is activated in a low beam mode capable of producing beam patterns 402, 404 as shown in FIGS. 5 and 6 respectively. Thus, when the lamp assembly 10 is functioning in the low beam mode, the selected corresponding light source 12 only emits light that propagates through one of the secondary low beam light guides 114*b* depending upon which region the lamp assembly 10 is in use, as described below.

Figure 7:
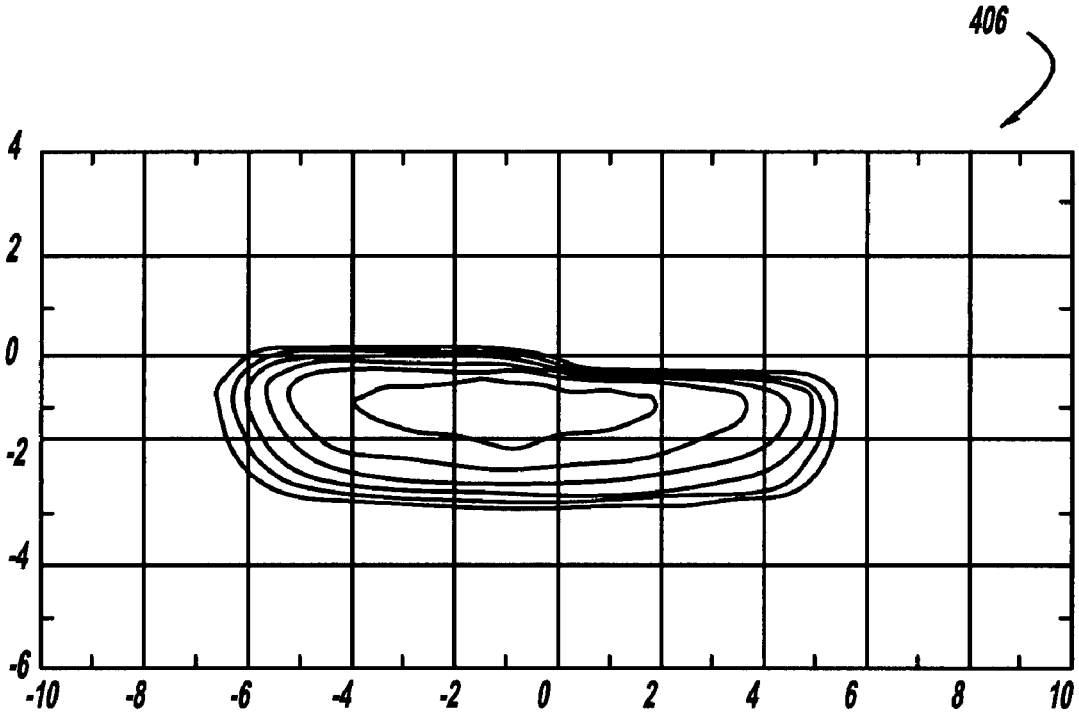
Figure 8:
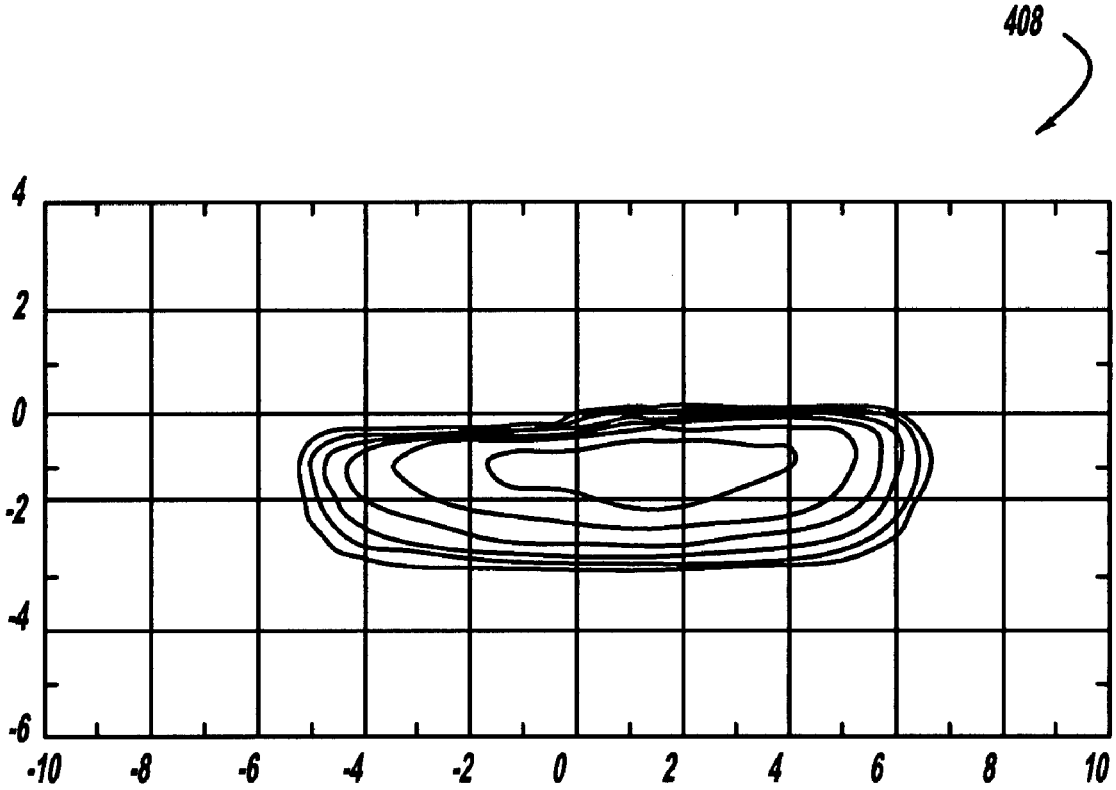

The secondary low beam light guides 114*b* are positioned relative to main low beam light guides 114*a* so that edges 117 and 115 are offset relative to each other. By having this stepped feature, the light emitted from the lamp assembly 10 has a greater amount of light being emitted higher in the beam patterns 406, 408 and on the side of the road associated with the energized secondary LED's 12 and light pipes 114*a* and 114*b* as shown in FIGS. 7 and 8 respectively, when compared to a lamp assembly that does not include light guides having the stepped feature.

Figure 9:
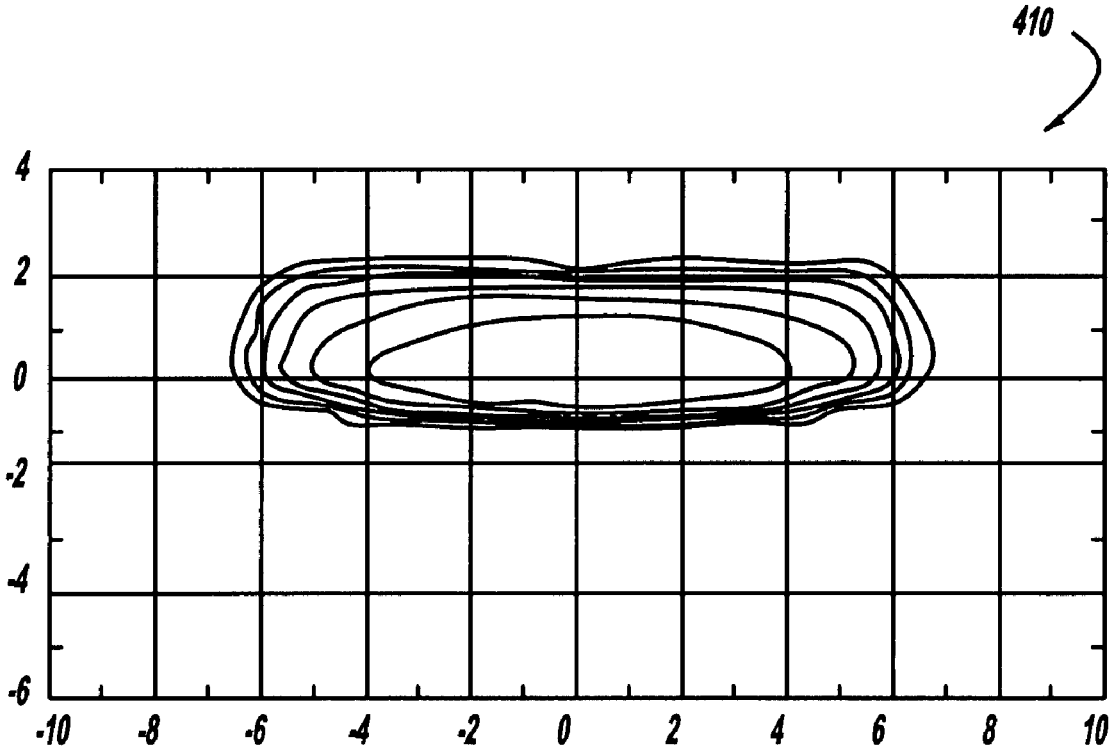
Figure 10:
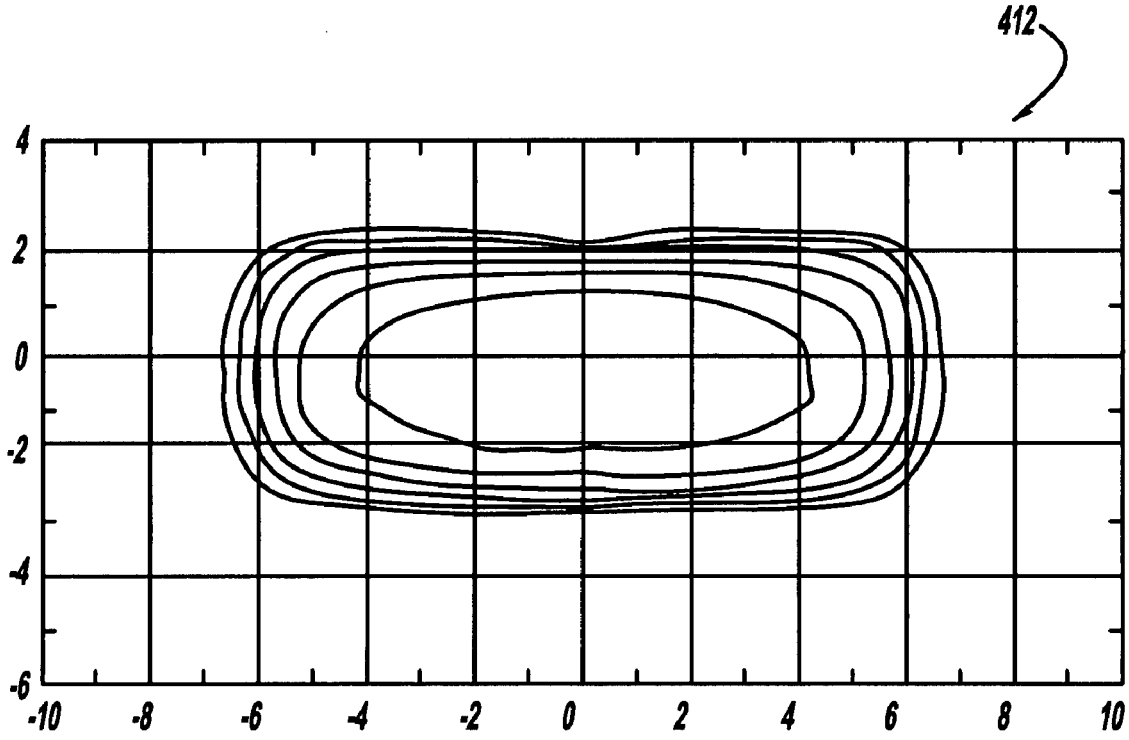

The plurality of light guides 14 also include a plurality of high beam light guides 214. The plurality of high beam light guides 214 each have a narrower width than each low beam light guide 114. This increases the intensity of the light emitted from the high beam light guides 214. Alternatively, as shown in FIG. 2, the high beam light guides 214 can be the same width as the low beam light guides 114, but the intensity of the light sources for the high beam light guides 214 can be greater instead of changing the width of each of the high beam light guides 214. The light sources 12 selectively emit light that is propagated through selected high beam light guides 214 when the lamp assembly 10 is activated in a high beam mode, to produce a beam pattern 410 as shown in FIG. 9. When the lamp assembly 10 is activated in the high beam mode, the corresponding light sources 12 emit light to propagate through all the high beam light guides 214 and low beam light guides 114, including both of the secondary low beam light guides 114*b*. When the lamp assembly 10 is functioning in the high beam mode, it is desirable to emit as much light over the greatest area as possible, and therefore, the light sources 12 selectively emit light that propagates through all of the low beam light guides 114 and high beam light guides 214, to produce a beam pattern 412 as shown in FIG. 10. The high beam light guides 214 can be below the low beam light guides 114 in the lamp assembly 10. However, it should be appreciated that the high beam light guides 214 can be positioned with respect to the low beam light guides 114 in any predetermined manner to control the area illuminated by the lamp assembly 10.

Figure 11:
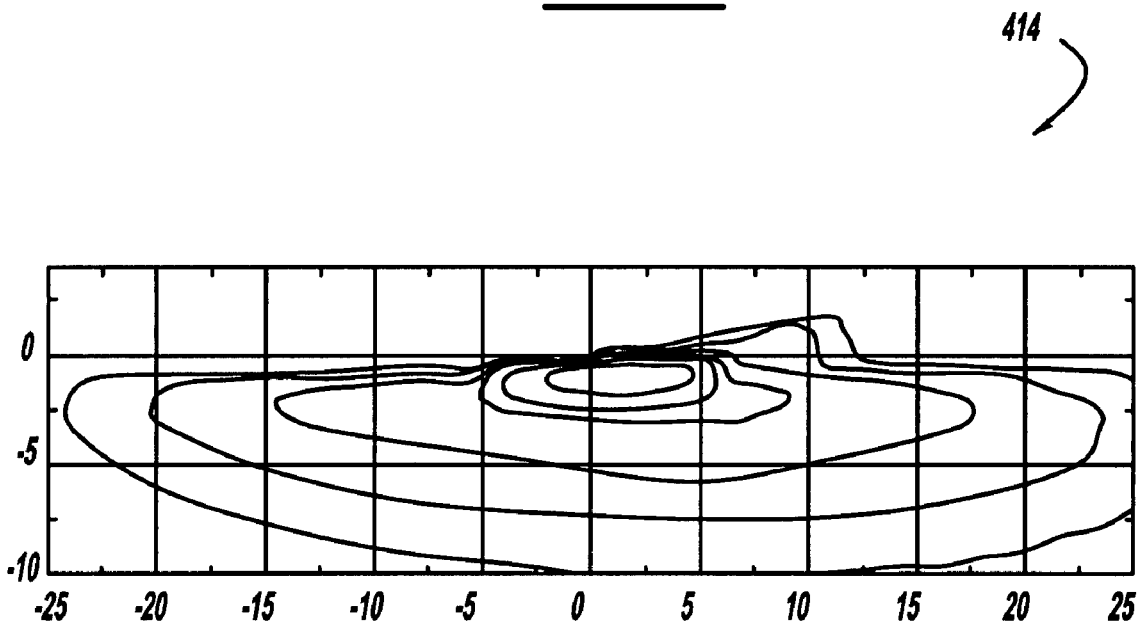

Additionally, the plurality of high beam light guides 214 can include two end high beam light guides 214*c* which form the ends of the plurality of high beam light guides 214. The high beam light guides 214*c* are positioned so edges 119 are directly adjacent to the low beam light guide 114*b* edges 115 mirroring the low beam stepped feature. This allows a continuous beam pattern 414 to be emitted from the lamp assembly 10 not having any dark bands or gaps as shown in FIG. 11.

Figure 12:
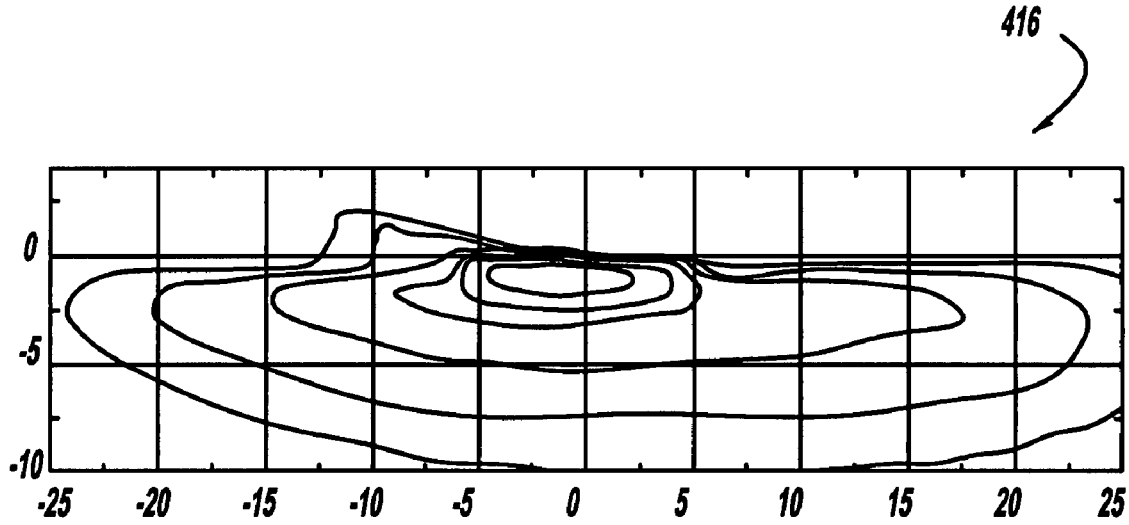
Figure 13:
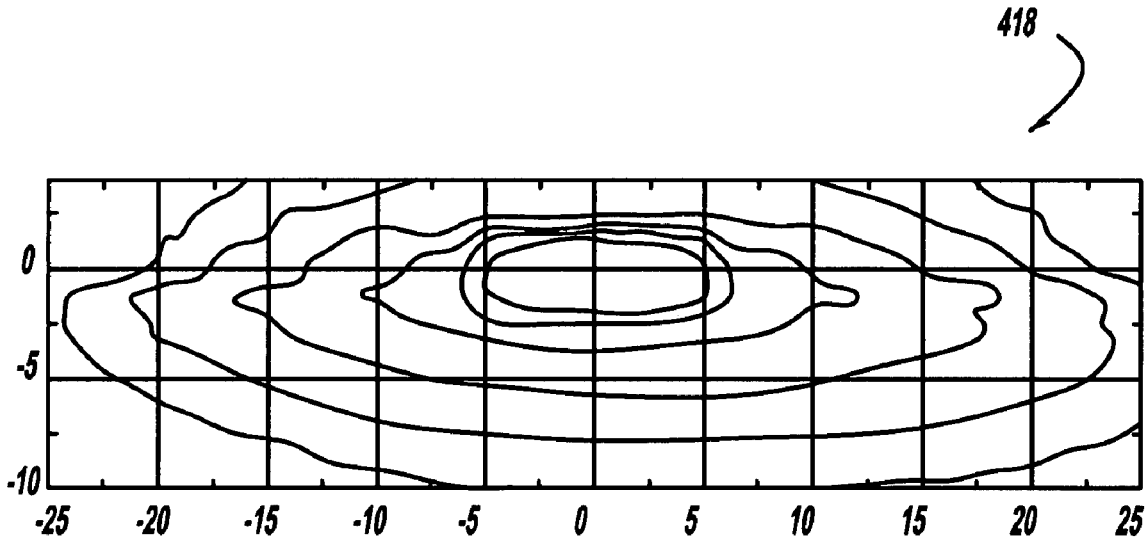
Figure 14:
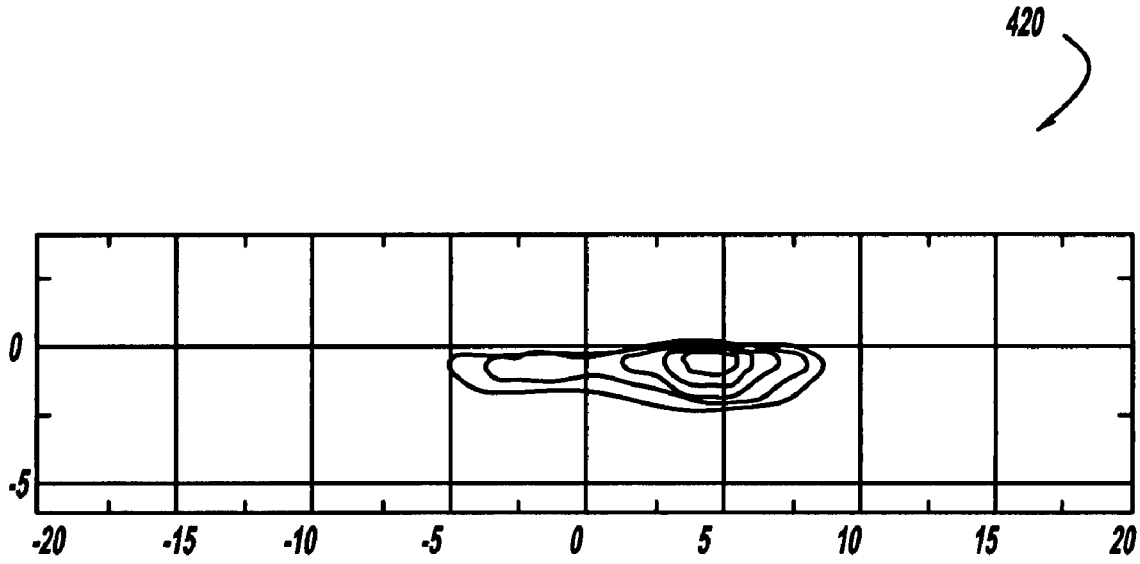
Figure 15:
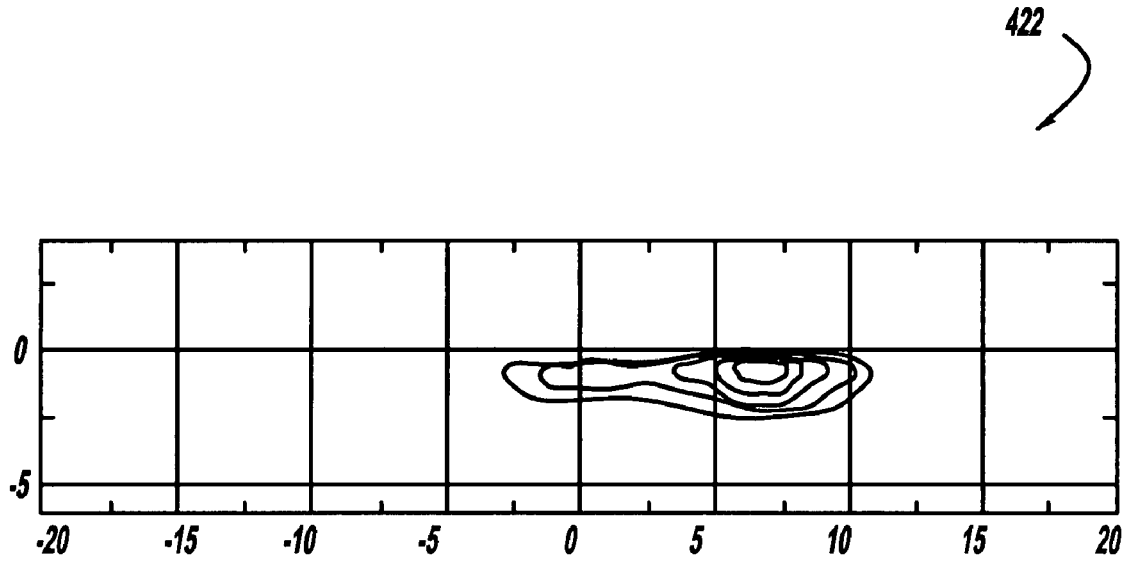
Figure 16:
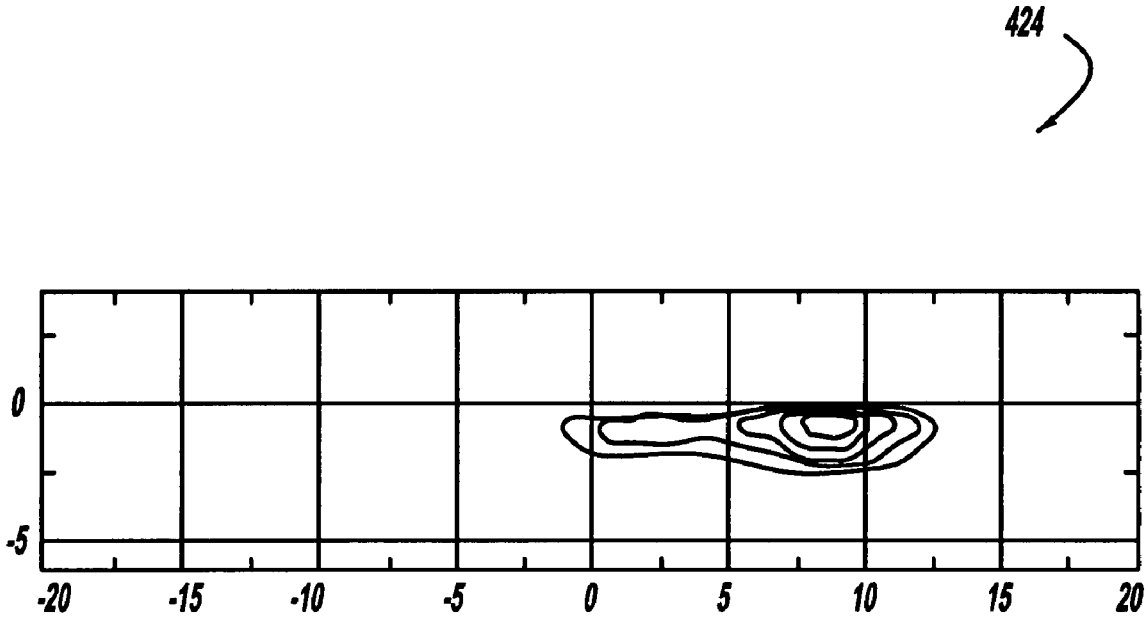
Figure 17:
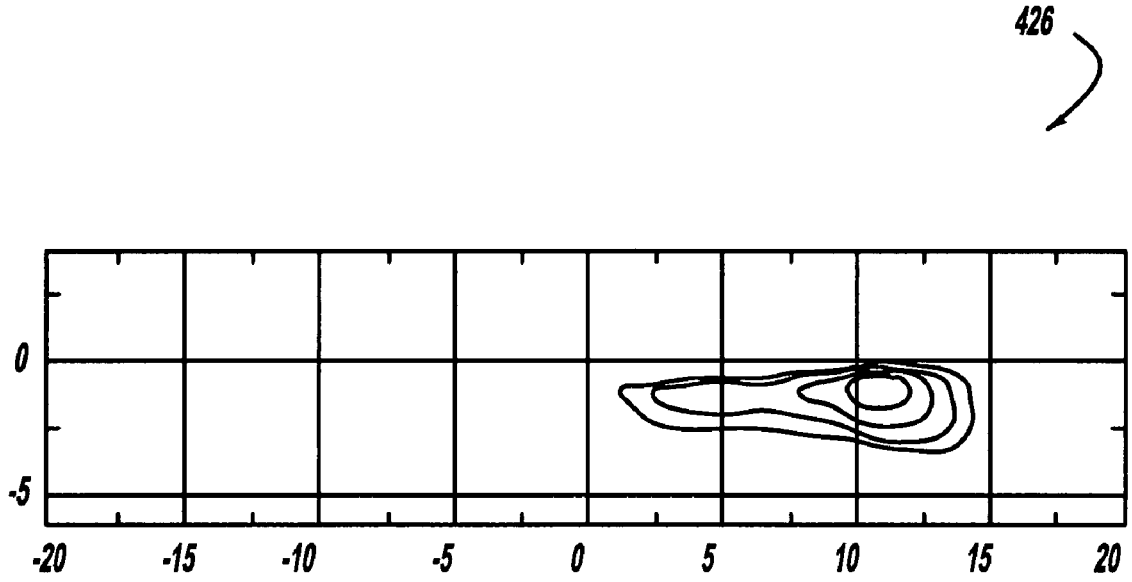
Figure 18:
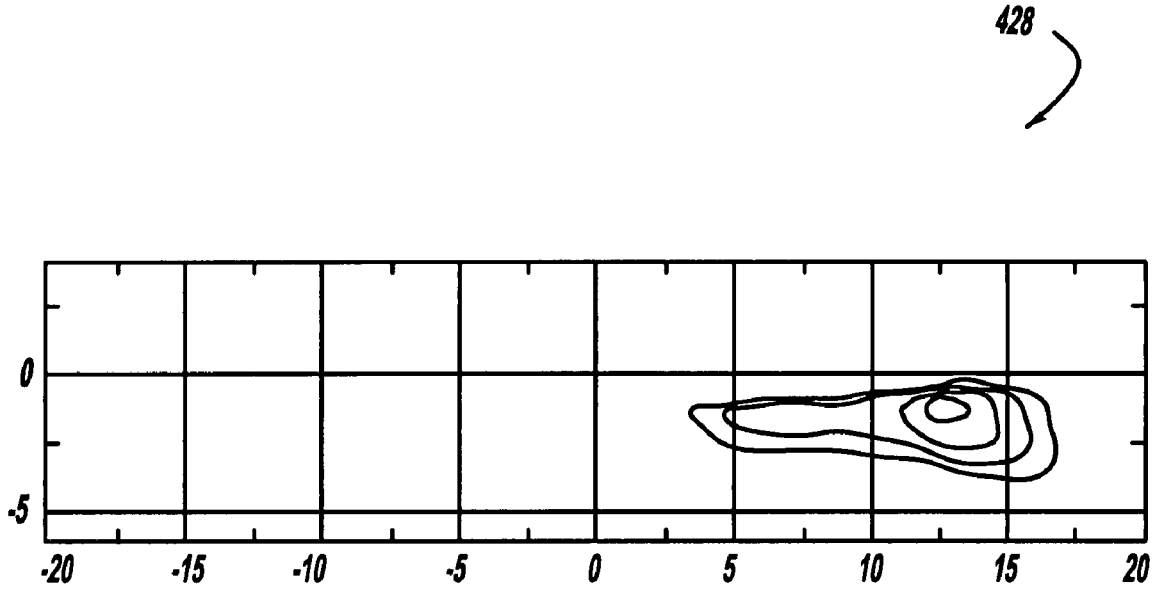
Figure 19:
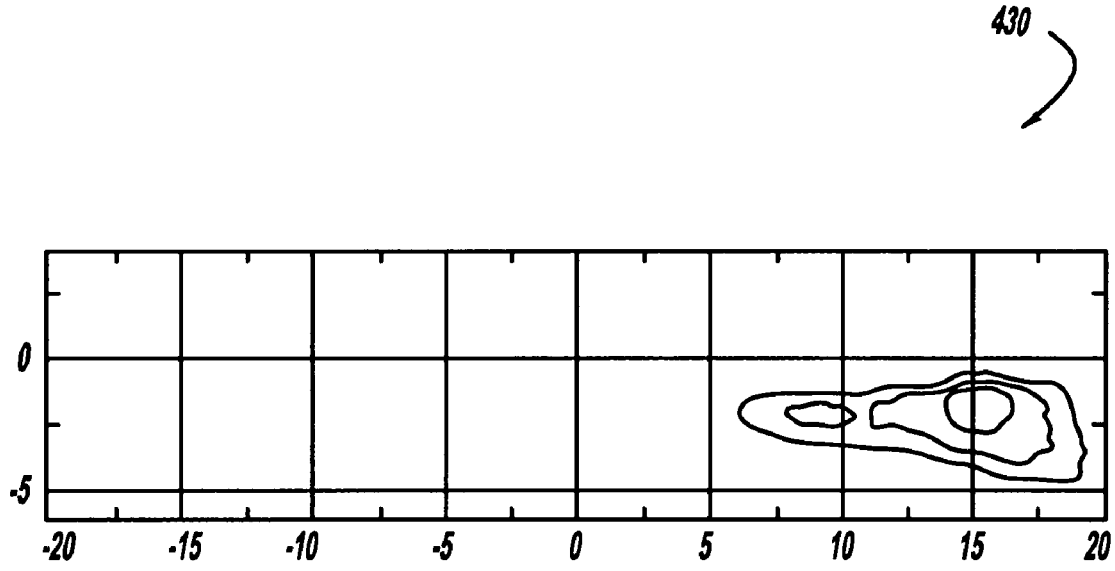

The plurality of light guides 14 can also include at least one bending light guide 314. The light sources 12 selectively emit light that is selectively propagated through the bending light guide 314 when the light assembly 10 is activated in a turning mode, as described below, producing a beam pattern 416 as shown in FIG. 12. The bending light guide may be wider than the other light guides in order to facilitate greater bending of the light from the light source. Alternatively, there are a plurality of bending light guides 314 which are adjacent to and offset from one another and producing progressive beams patterns 418, 420, 422, 424, 426, 428, 430 as shown in FIGS. 13 through 19 respectively.

Typically, the light guides 14 have an asymmetric light emitting surface 18, and the lens 16 has a symmetrical optical prescription. The combination of the light guide 14 having an asymmetrical light emitting surface 18 and the lens 16 having a symmetric optical prescription, allows for the desired light pattern to be projected from the lamp assembly 10. The asymmetric light emitting surface 18 and symmetrical optical prescription of the lens 16 are dependent upon one another in order to produce the desired projection from the light assembly 10. Thus, altering either or both of the asymmetric light emitting surface 18 and symmetrical optical prescription of the lens 16 alters the light pattern emitted from the lamp assembly 10.

By way of explanation and not limitation, in operation the lamp assembly 10 is used on a motorized vehicle (not shown). The lamp assembly 10 includes a housing 20 for the light sources 12, a bracket assembly 22 for connecting the lamp assembly 10 to the motorized vehicle, and a housing 24 for the light guides 14 and lens 16. When the lamp assembly 10 is activated in the low beam mode, a controller 21 determines the selected light sources 12, which emit light that selectively propagates light through the main low beam light guides 114*a*. The controller 21 can be external to the housing 20 or it can be integrated within the housing. Depending upon which region the motorized vehicle is being used in and the illumination requirements for a lamp assembly 10 in that region, such as but not limited to, whether the vehicle is being operated in a region which requires the vehicle to drive on the right side of the road or the left side of the road, the selected secondary low beam light guide 114*b* will be activated. Thus, if the vehicle is being operated where the vehicle is driven on the right hand side of the road, the secondary low beam light guide 114*b* that is adjacent the bending light guide 314 is selectively used to propagate light from the light source 12. By using the main low beam light guide 114*a* and the selected secondary low beam light guide 114*b*, a hot spot or a position on the lamp assembly 10 where the light emitted is most concentrated is formed. The hot spot can be used to determine if the lamp assembly 10 complies with the lamp assembly regulations in the region the vehicle is being operated. However, if the vehicle is being operated in a region where the vehicle was driven on the left hand side of the road, and the other secondary low beam light guide 114*b* was activated with the main low beam light guide 114*a*, the hot spot is shifted to the side of the lamp assembly 10 where the secondary low beam light guide 114*b* is activated.

When the lamp assembly 10 is activated in the high beam mode, the controller 21 determines the selected light sources 12 which propagate light through the selected low beam light guides 114 and the high beam light guides 214. Thus, both the secondary low beam light guides 114*b* are used in addition to the main low beam light guides 114*a* and high beam light guides 214 because when the lamp assembly 10 is being operated in a high beam mode it is desirable to emit light over the greatest region the lamp assembly 10 is capable. Additionally, the controller 21 determines the selected light sources 12 which can selectively propagate light through the bending light guides 314 when the lamp assembly 10 is operated in the turning mode. The lamp assembly 10 is operated in the turning mode when the vehicle is making a turn and it is desirable to light a region that is offset from the vehicle in which the vehicle is turning.

By including an individual light source 12 for each light guide 14, the light sources 12 can be selectively activated by the control unit, depending upon which of the light guides it is desirable to emit light from. Thus, if the vehicle changes regions, the controller 21 can be used to activate different light sources 12 in order to comply with that region's lamp assembly 10 requirements, without requiring any mechanical movement of the components of the lamp assembly 10. Further, a single lamp assembly 10 can be manufactured and used on motorized vehicles that are used in multiple regions, such that the control unit is used to alter the area illuminated by the lamp assembly 10 rather than altering mechanical components. The beam patterns depicted in FIGS. 4-19 are merely exemplary and the actual beam pattern can vary depending on the desired pattern or the particular application of the invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A vehicular lamp assembly comprising:

a plurality of light sources within said lamp assembly;

a plurality of light guides, each one of said plurality of light guides optically connected to a respective one of said plurality of light sources, and each of said plurality of light guides having an asymmetric light emitting surface;

a controller connected to said plurality of light sources, wherein said controller is configured to selectively activate one or more of said plurality of light sources to emit light through said plurality of light guides; and a lens having a symmetrical optical prescription, said lens being optically connected to all of said plurality of light guides, wherein said symmetrical optical prescription of said lens and said asymmetric light emitting surface of each of said plurality of light guides form a light pattern emitted from said lamp assembly.

2. The lamp assembly of claim 1, wherein said plurality of light guides have one or more main low beam light guides.

3. The lamp assembly of claim 2 further comprising one or more secondary low beam light guides forming part of said plurality of low beam light guides adjacent to both sides of said one or more main low beam light guides, wherein a selected one of said secondary low beam light guides is activated when said lamp assembly is activated in a low beam mode.

4. The lamp assembly of claim 3, wherein said one or more secondary low beam light guides have a stepped edge that is offset from an edge of at least one of said one or more main low beam light guides.

5. The lamp assembly of claim 4 wherein said one or more secondary low beam light guides is narrower in width than the width of said one or more main low beam light guides.

6. The lamp assembly of claim 1, wherein a portion of said plurality of light guides have one or more high beam light guides, and said one or more high beam light guides selectively propagate light from selected said light sources when said lamp assembly is activated in a high beam mode.

7. The lamp assembly of claim 6, further comprising one or more end high beam light guides adjacent said one or more high beam light guides, wherein said one or more end high beam light guides has a stepped edge that is offset from an edge of said one or more high beam light guides.

8. The lamp assembly of claim 6 further comprising one or more end high beam light guides adjacent said one or more high beam light guides, wherein said one or more end high beam light guides are narrower in width than the width of said one or more high beam light guides.

9. The lamp assembly of claim 1, wherein said plurality of light guides have at least one bending light guide, wherein said at least one bending light guide selectively propagates light from selected said light sources when said lamp assembly is activated in a turning mode.

10. The lamp assembly of claim 9, wherein said at least one bending light guide has greater width than said plurality of light guides that are not bending light guides, wherein said width of said at least one bending light guide permits the bending of light emitted from the at least one bending light guide.

11. The lamp assembly of claim 10, wherein adjacent said bending light guides are offset with respect to one another.

12. A vehicular lamp assembly comprising:

a plurality of light sources within said lamp assembly;

a plurality of light guides having a plurality of low beam light guides and a plurality of high beam light guides, each one of said plurality of light guides optically connected to a respective one of said plurality of light sources, and each one of said plurality of light guides having an asymmetric light emitting surface;

a controller connected to said plurality of light sources, wherein said controller selectively activates one or more of said plurality of light sources emit light that selectively propagates through said plurality of light guides based upon at least one of illumination requirements in a region for said lamp assembly and a mode of operation of said lamp assembly; and a lens having a symmetrical optical prescription, said lens being optically connected to all of said plurality of light guides, wherein said symmetrical optical prescription of said lens and said asymmetric light emitting surface of each of said plurality of light guides form a light pattern emitted from said lamp assembly.

13. The lamp assembly of claim 12, wherein said plurality of low beam light guides have one or more main low beam light guides and two or more secondary low beam light guides, said two or more secondary low beam light guides are adjacent to both sides of said main low beam light guide and said controller activates a selected one of said plurality of light sources to propagate light in a selected one of said two or more secondary low beam light guides when said lamp assembly is activated in a low beam mode.

14. The lamp assembly of claim 13, wherein said two or more secondary low beam light guides have a stepped edge that is offset from an edge of at least one of said one or more low beam light guides.

15. The lamp assembly of claim 14 wherein said two or more secondary low beam light guides is narrower in width that the width of said one or more low beam light guides.

16. The lamp assembly of claim 12, further comprising one or more end high beam light guides adjacent said one or more high beam light guides, wherein said one or more high beam light guides has a stepped edge that is offset from an edge of said one or more high beam light guides.

17. The lamp assembly of claim 12, further comprising one or more end high beam light guides adjacent said one or more high beam light guides, wherein said one or more end high beam light guides are narrower in width than the width of said one or more high beam light guides.

18. The lamp assembly of claim 12, wherein said plurality of light guides have at least one bending light guide, wherein said at least one bending light guide selectively propagates light emitted from selected light sources when said lamp assembly is activated in a turning mode.

19. The lamp assembly of claim 18 wherein said at least one bending light guide has greater width than said plurality of light guides that are not bending light guides, wherein said width of said at least one bending light guide permits the bending of light emitted from the at least one bending light guide.

20. The lamp assembly of claim 19 wherein adjacent said bending light guides are offset with respect to one another.

21. The lamp assembly of claim 12, wherein said plurality of light sources are light emitting diodes (LEDs).

22. A vehicular lamp assembly comprising:

a plurality of light emitting diodes (LEDs) within said lamp assembly;

a plurality of light guides having an asymmetrical emitting surface including a plurality of low beam light guides, a plurality of high beam light guides, and a plurality of bending light guides, each one of said plurality of light guides being optically connected to a respective one of said plurality of light emitting diodes, and each one of said plurality of light guides having an asymmetric light emitting surface;

a controller connected to said plurality of light emitting diodes, wherein said controller selectively activates said plurality of light emitting diodes to emit light that selectively propagates through said plurality of light guides based upon at least one of illumination requirements in a region for said lamp assembly and a mode of operation of said lamp assembly; and a lens optically connected to all of said plurality of light guides, wherein said lens has a symmetrical optical prescription, and said symmetrical optical prescription of said lens and said asymmetric light emitting surface of each of said plurality of light guides form a light pattern emitted from said lamp assembly.

23. The lamp assembly of claim 22, wherein said plurality of light guides have one or more main low beam light guides and one or more secondary low beam light guides forming part of said plurality of low beam light guides, said one or more secondary low beam light guides being adjacent to both sides of said one or more main low beam light guides and a selected one of said one or more secondary low beam light guides are activated when said lamp assembly is activated in a low beam mode.

24. The lamp assembly of claim 23, wherein said one or more secondary low beam light guides have a greater length than said one or more main low beam light guides so that said one or more secondary low beam light guides are stepped with respect to said one or more main low beam light guides.

25. The lamp assembly of claim 22, wherein at least one end high beam light guide of said plurality of high beam light guides has a greater length than the remaining said one or more high beam light guides so that said at least one end high beam light guides are stepped with respect to said remaining said one or more high beam light guides.

26. The lamp assembly of claim 22, wherein adjacent said bending light guides are offset with respect to one another.

* * * * *

UNITED STATES PATENT AND TRADEMARK OFFICE

CERTIFICATE OF CORRECTION

PATENT NO. : 7,677,777 B2
APPLICATION NO. : 11/709042
DATED : March 16, 2010
INVENTOR(S) : Woodward et al.

It is certified that error appears in the above-identified patent and that said Letters Patent is hereby corrected as shown below:

Column 5,
Line 63, "sources emit" should be -- sources to emit --.

Column 6,
Line 26, "more high" should be -- more end high --.

Signed and Sealed this

Twenty-fifth Day of May, 2010

David J. Kappos

David J. Kappos
*Director of the United States Patent and Trademark Office*